US007845298B2

(12) United States Patent
Rayner et al.

(10) Patent No.: US 7,845,298 B2
(45) Date of Patent: Dec. 7, 2010

(54) SUBMERSIBLE VEHICLE OBJECT EJECTION SYSTEM USING A FLYWHEEL DRIVEN BOOST PUMP

(75) Inventors: Jeffrey S. Rayner, Gilbert, AZ (US); Paul T. Wingett, Mesa, AZ (US); John R. Toon, Phoenix, AZ (US); Sharon K. Brault, Chandler, AZ (US)

(73) Assignee: Honeywell International Inc., Morristown, NJ (US)

( * ) Notice: Subject to any disclaimer, the term of this patent is extended or adjusted under 35 U.S.C. 154(b) by 1255 days.

(21) Appl. No.: 11/122,832

(22) Filed: May 4, 2005

(65) Prior Publication Data

US 2006/0249067 A1 Nov. 9, 2006

(51) Int. Cl.
*B63G 8/32* (2006.01)

(52) U.S. Cl. ..... 114/238; 89/5; 318/150

(58) Field of Classification Search ..... 114/238, 114/239; 74/433.5; 322/4; 318/150; 89/37.06, 89/5

See application file for complete search history.

(56) References Cited

U.S. PATENT DOCUMENTS 2,688,704 A * 9/1954 Christenson ..... 290/4 C
3,089,389 A * 5/1963 Andrews et al. ..... 89/1.816
3,182,554 A * 5/1965 Barakauskas ..... 89/1.81
3,609,426 A * 9/1971 Gaul ..... 322/4
4,163,367 A * 8/1979 Yeh ..... 60/414
4,414,805 A * 11/1983 Walker ..... 60/792
4,462,269 A * 7/1984 Inglis ..... 74/433.5
5,174,235 A * 12/1992 Moody ..... 114/238
5,284,106 A * 2/1994 Meng ..... 114/238
5,305,862 A * 4/1994 Gierer ..... 192/3.3
5,438,945 A * 8/1995 Moody ..... 114/238
5,568,782 A * 10/1996 Moody ..... 114/238
5,834,674 A * 11/1998 Rodriguez et al. ..... 89/1.81
6,020,657 A * 2/2000 Liran ..... 307/64
6,118,193 A * 9/2000 Morris ..... 310/74
6,119,549 A * 9/2000 Yamamoto ..... 464/68.4
6,220,196 B1 * 4/2001 Escarrat ..... 114/238
6,457,306 B1 * 10/2002 Abel et al. ..... 60/204
6,547,527 B2 * 4/2003 Gaither ..... 417/16
6,573,626 B1 * 6/2003 Gosebruch et al. ..... 310/74
6,755,482 B2 * 6/2004 Johnson ..... 299/39.4
6,784,562 B2 * 8/2004 Gennesseaux ..... 290/2
6,854,409 B1 * 2/2005 Galliano ..... 114/238
6,871,610 B1 * 3/2005 Galliano ..... 114/238
7,093,552 B2 * 8/2006 Owen ..... 114/238
2004/0072649 A1 * 4/2004 Kohno et al. ..... 477/98
2006/0249067 A1 * 11/2006 Rayner et al. ..... 114/238

* cited by examiner

*Primary Examiner*—Benjamin P Lee
(74) *Attorney, Agent, or Firm*—Ingrassia Fisher & Lorenz, P.C.

(57) ABSTRACT

An object ejection system uses an energy storage flywheel to drive the fluid pump that is used to pressurize the ejection tubes. The energy storage flywheel is periodically spun-up using an electric motor. The energy stored in the energy storage flywheel is used, when needed, to drive the fluid pump and supply pressurized fluid to an impulse tank. The pressurized fluid in the impulse tank is used to eject an object, such as a weapon, from one or more ejection tubes.

19 Claims, 3 Drawing Sheets

SUBMERSIBLE VEHICLE OBJECT EJECTION SYSTEM USING A FLYWHEEL DRIVEN BOOST PUMP

TECHNICAL FIELD

The present invention relates to a submersible vehicle object ejection system and, more particularly, to a object ejection system that uses a flywheel driven boost pump to pressurize the object system ejection tubes.

BACKGROUND

Many submersible vehicles, such as military submarines, include one or more object ejection systems. An object ejection system may be used to eject various types of objects from the vehicle. Such objects may include, for example, sonar buoys, counter measure devices, and various types of weapons, such as torpedoes and/or missiles. A typical object ejection system that is used to eject weapons from a submersible vehicle includes one or more weapon ejection tubes, an impulse tank, a boost pump, and an air turbine.

A weapon may be launched from an ejection tube by fluidly communicating the ejection tube with an impulse tank by, for example, opening a slide valve on the ejection tube, and then pressurizing the impulse tank with fluid. In many ejection systems the impulse tank is pressurized by commanding a firing valve to the open position, which allows high pressure air to flow to the air turbine. The air turbine, upon receiving the flow of high pressure air, drives the boost pump, which draws fluid (e.g., seawater) from the environment surrounding the vehicle hull and discharges the fluid, at a higher pressure, into the impulse tank.

Although the ejection system described above is generally safe, reliable, and robust, it does suffer certain drawbacks. For example, the system includes numerous components, such as one or more high pressure air storage tanks, the firing valve, and the interconnecting piping. These components take up space within a submersible vehicle hull, and add to the overall vehicle weight. Moreover, because operation with a relatively quiet acoustic signature may be desirable, these components can be relatively costly to design, produce, and install, and can exhibit relatively high maintenance frequencies. One proposed solution to these drawbacks has been to use an electric motor to drive the boost pump. However, the size of the electric motor that is needed to meet system functional requirements can be relatively large and costly.

Hence, there is a need for an object ejection system that may be implemented with relatively fewer components than present pneumatic systems and/or takes up less space and/or reduces overall vehicle weight and/or is less relatively costly to design, produce, and install and/or has relatively low maintenance frequencies. The present invention addresses one or more of these needs.

BRIEF SUMMARY

The present invention provides an object ejection system that includes a flywheel driven fluid pump to pressurize the object ejection system ejection tubes.

In one embodiment, and by way of example only, a submersible vehicle object ejection system includes a fluid supply conduit, an impulse tank, a fluid pump, an energy storage flywheel, a motor, a control circuit, and a gear train. The fluid supply conduit has at least an inlet port coupled to a fluid source of a first pressure. The impulse tank is configured to receive fluid at a second pressure that is greater than the first pressure. The fluid pump is configured to receive a rotational drive force and is operable, upon receipt thereof, to pump fluid from the fluid source into the impulse tank at the second pressure. The energy storage flywheel is rotationally mounted and is adapted to receive rotational energy. The energy storage flywheel is additionally configured to store the received rotational energy and to supply the stored rotational energy. The motor is coupled to the energy storage flywheel and is configured, upon being electrically energized, to supply the rotational energy to the energy storage flywheel at a rotational speed. The control circuit is configured to selectively energize the motor and, upon energizing the motor, to control the rotational speed thereof. The gear train is coupled between the energy storage flywheel and the fluid pump, and is configured to receive the stored rotational energy supplied by the energy storage flywheel and, in response, supply the rotational drive force to the fluid pump.

Other independent features and advantages of the preferred object ejection system will become apparent from the following detailed description, taken in conjunction with the accompanying drawings which illustrate, by way of example, the principles of the invention.

DETAILED DESCRIPTION OF A PREFERRED EMBODIMENT

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1:
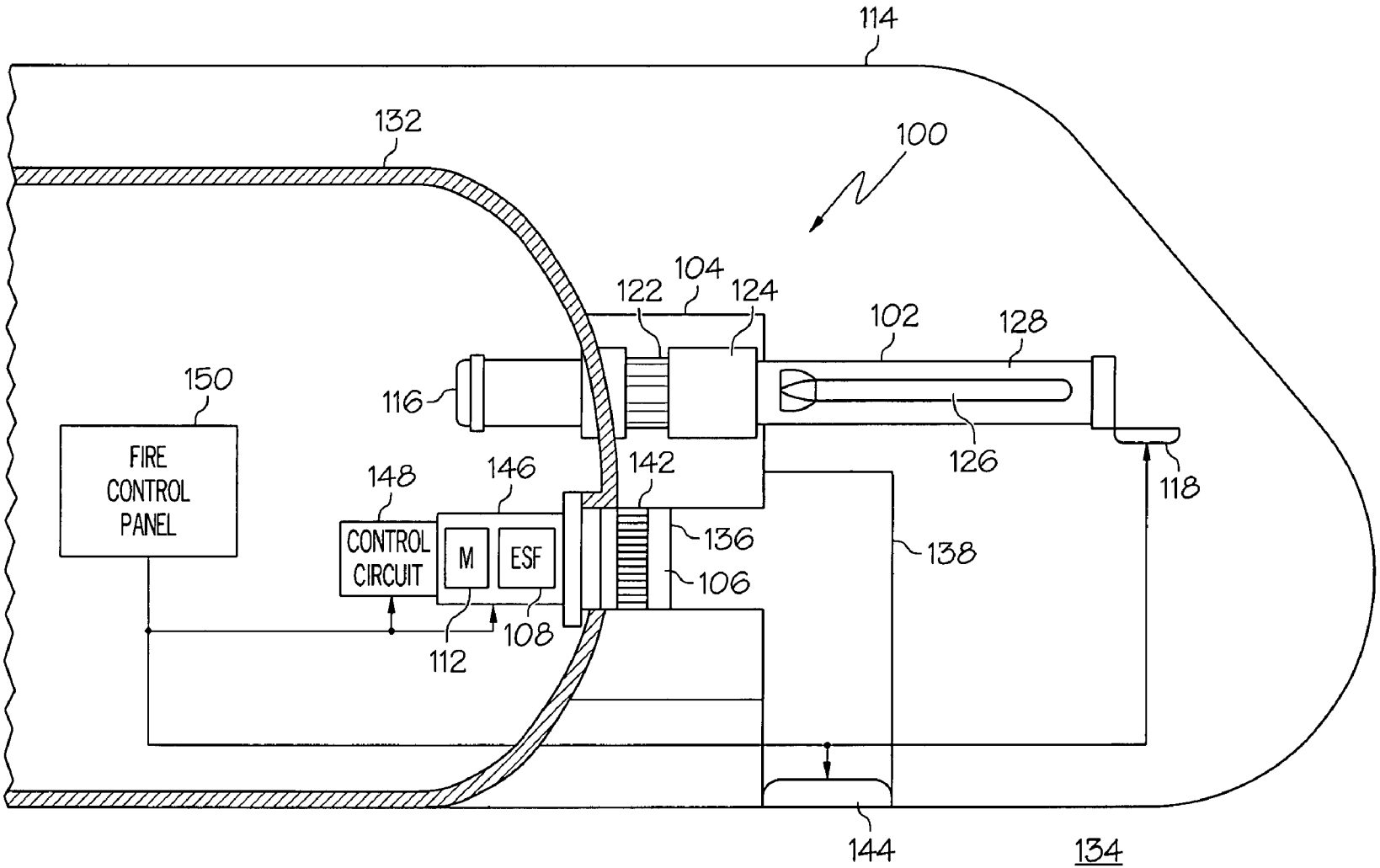
FIG. 1 is a schematic representation of a portion of a submersible vehicle hull illustrating an object ejection system according to an exemplary embodiment of the present invention.

Referring now to FIG. 1, a submersible vehicle object ejection system 100 is illustrated schematically and includes one or more ejection tubes 102 (for clarity, only one shown), an impulse tank 104, a fluid pump 106, an energy storage flywheel 108, and a motor 112, all disposed within, or at least partially within, the vehicle hull 114. The ejection tubes 102 each include a breach door 116, a muzzle door 118, a plurality of fluid inlets 122, and a slide valve 124. The breach doors 116 are opened to load a weapon 126, or other object, into an inner volume 128 of the ejection tubes 102, and are then closed to seal the inner volume 128 from the inner hull 132. The muzzle doors 118 are normally closed to isolate the ejection tube inner volumes 128 from the environment 134 surrounding the vehicle hull 114, but are opened to allow ejection of the weapon 126 from the ejection tube 102 into the environment 134.

The fluid inlets 122 extend through the ejection tubes 102 and, depending on the position of the respective slide valves 124, fluidly communicate the impulse tank 104 to the inner volume 128 of the ejection tubes 102. In particular, the slide valves 124 are disposed between the fluid inlets 122 of the associated ejection tubes 102 and the impulse tank 104, and are moveable between an open position, in which the impulse tank 104 is fluidly communicated to the ejection tube inner volume 128, and a closed position, in which the impulse tank 104 is fluidly isolated from the ejection tube inner volume 128.

The impulse tank 104 is used to communicate pressurized fluid, such as water, to an ejection tube 102 that has its slide valve 124 open. The pressurized fluid in the impulse tank 104 is used to eject the weapons 126 from the ejection tubes 102. The pressurized fluid is supplied to the impulse tank 104 via the fluid pump 106. More specifically, at least in the depicted embodiment, the fluid pump 106 includes a fluid inlet 136 in fluid communication with a fluid supply conduit 138, and a fluid outlet 142 in fluid communication with the impulse tank 104. The fluid supply conduit 138 includes a fluid inlet valve 144 that, when open, allows fluid from the surrounding environment 134 to enter into the fluid supply conduit 138. The fluid pump 106, when driven, pumps fluid that enters the fluid supply conduit 138 into the impulse tank 104 at an increased pressure. The pressurized fluid supplied to the impulse tank 104 is used to eject the weapon 126 from a selected ejection tube 102.

The fluid pump 106 is driven by the energy storage flywheel 108, which is rotationally mounted within a housing 146. The energy storage flywheel 108, as is generally known, is a mechanical battery that is configured to selectively store and supply rotational mechanical energy. In the depicted embodiment, the motor 112, which is also preferably mounted within the housing 146, is used to maintain the so-called charge of the energy storage flywheel 108. More specifically, a control circuit 148, which preferably is mounted either on or near the housing 146, determines the rotational speed of the energy storage flywheel 108 and, if the control circuit 148 determines that the energy storage flywheel 108 is rotating below a predetermined rotational speed, the control circuit 148 energizes the motor 112. In response, the motor 112 supplies rotational energy to the energy storage flywheel 108, spinning the energy storage flywheel 108 up to a predetermined rotational speed. Once the control circuit 148 determines that the energy storage flywheel 108 is rotating at the predetermined rotational speed, the control circuit 148 de-energizes the motor 112. It will be appreciated that the control circuit 148 additionally implements a suitable control law that controls the acceleration rate of the motor 112, and thus the acceleration rate/charging rate energy storage flywheel 108.

The object ejection system 100 is preferably controlled from a central control panel 150, such as a fire control panel. The fire control panel 150 may be located within the same compartment as the other portions of the object ejection system 100 or in a different compartment or space within the vehicle hull 114. For example, in many military submarine applications the fire control panel 150 may be located within the control space (not shown). No matter its physical location, it will be appreciated that the fire control panel 150 includes various controls and man-machine interfaces that allow an operator to remotely control, for example, the position of the ejection tube muzzle doors 118, the slide valves 124, and fluid inlet valve 144. The fire control panel 150 may also be configured to monitor and/or control the operations of the energy storage flywheel 108, the motor 112, and the control circuit 148.

Figure 2:
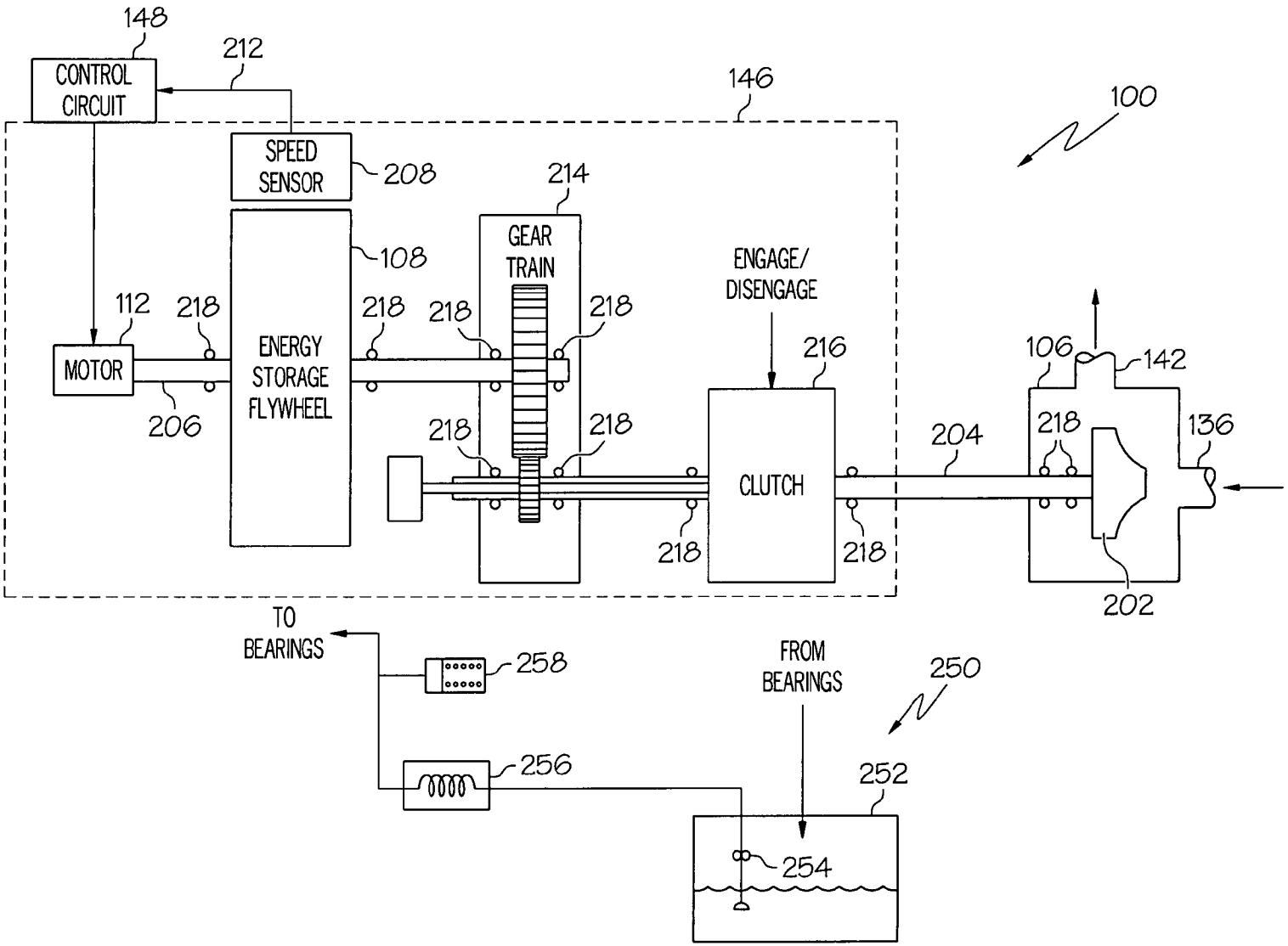
FIG. 2 is a schematic representation of a portion of the object ejection system shown in FIG. 1, according to one exemplary embodiment of the present invention.

Having provided a general description of the object ejection system 100, a more detailed description of a particular physical implementation thereof will now be provided. In doing so, reference should now be made to FIG. 2 in which various components of the object ejection system 100, and the physical interconnections thereof, are illustrated. As shown in FIG. 2, the fluid pump 106 is preferably implemented as a centrifugal pump and includes an impeller 202, rotationally mounted on an input shaft 204, to pump fluid from the fluid inlet 136 to the fluid outlet 142.

As FIG. 2 also shows, the energy storage flywheel 108 is rotationally mounted on a flywheel shaft 206 within the housing 146. The motor 112 is coupled to the energy storage flywheel 108 via the flywheel shaft 206. It will be appreciated that the energy storage flywheel 108 and motor 112 may be implemented using any one of numerous types of flywheels and motors now known or developed in the future. In particular, the motor 112 may be any one of numerous types of AC or DC motors, but in a preferred embodiment, the motor 112 is implemented as a brushless DC motor.

A speed sensor 208, which is also disposed within the housing 146, is configured to sense the rotational speed (or charge state) of the energy storage flywheel 108. The speed sensor 208 in turn supplies a speed signal 212 to the control circuit 148 that is representative of flywheel rotational speed. The control circuit 148 preferably uses this speed signal 212 to determine the rotational speed of the energy storage flywheel 108 and, based on the determined speed, whether to energize or de-energize the motor 112. It will be appreciated that the speed sensor 208 may be implemented as any one of numerous types of rotational speed sensors now known or developed in the future, including for example, an optical sensor, a Hall effect sensor, a potentiometer, and a resolver.

In addition to each of the previously described components, the ejection system 100 further includes a gear train 214 and a clutch 216. The gear train 214, which may be implemented using any one of numerous types of gear arrangements, is preferably configured as a step-down gear train and is coupled to the flywheel shaft 206. As such, it receives a rotational drive force from the energy storage flywheel 108 at first rotational speed, and supplies the rotational drive force to the pump 106, via the clutch 216, at a second, lower rotational speed.

The clutch 216 is disposed between the gear train 214 and the fluid pump input shaft 204 and selectively couples the gear train 214 to, and decouples the gear train 214 from, the fluid pump input shaft 204. To do so, the clutch 216 is coupled to receive clutch engage and clutch disengage commands from, for example, the fire control panel 150 (not shown in FIG. 2). In response to a clutch engage command, the clutch 216 couples the gear train 214 to the pump input shaft 204, thereby supplying a rotational drive to the impeller 202. Conversely, in response to a clutch disengage command, the clutch 216 decouples the gear train 214 from the pump input shaft 204. It will be appreciated that the clutch 216 may be implemented using any one of numerous know clutch configurations. In a particular preferred embodiment, however, the clutch 216 is implemented as an electromagnetic clutch.

For completeness, FIG. 2 also depicts a lubricant supply system 250. The lubricant supply system 250 is used to supply lubricant, such as oil, to various bearing assemblies 218 that are used to rotationally mount various components within the ejection system 100, and may also be used to supply lubricant to other non-illustrated systems. In the depicted embodiment, the lubricant supply system 250 includes a lubricant reservoir 252, a lubricant pump 254, a heat exchanger 256, and an accumulator 258. The lubricant reservoir 252 stores a volume of lubricant, such as oil. The lubricant pump 254 draws lubricant from the reservoir 252, circulates the lubricant through the heat exchanger 256 and various conduits, and supplies the lubricant to the bearing assemblies 218. The conduits 262 also discharge the lubricant back into the reservoir 252 for recirculation. The accumulator maintains fluid pressure within the lubricant supply system 250.

Figure 3:
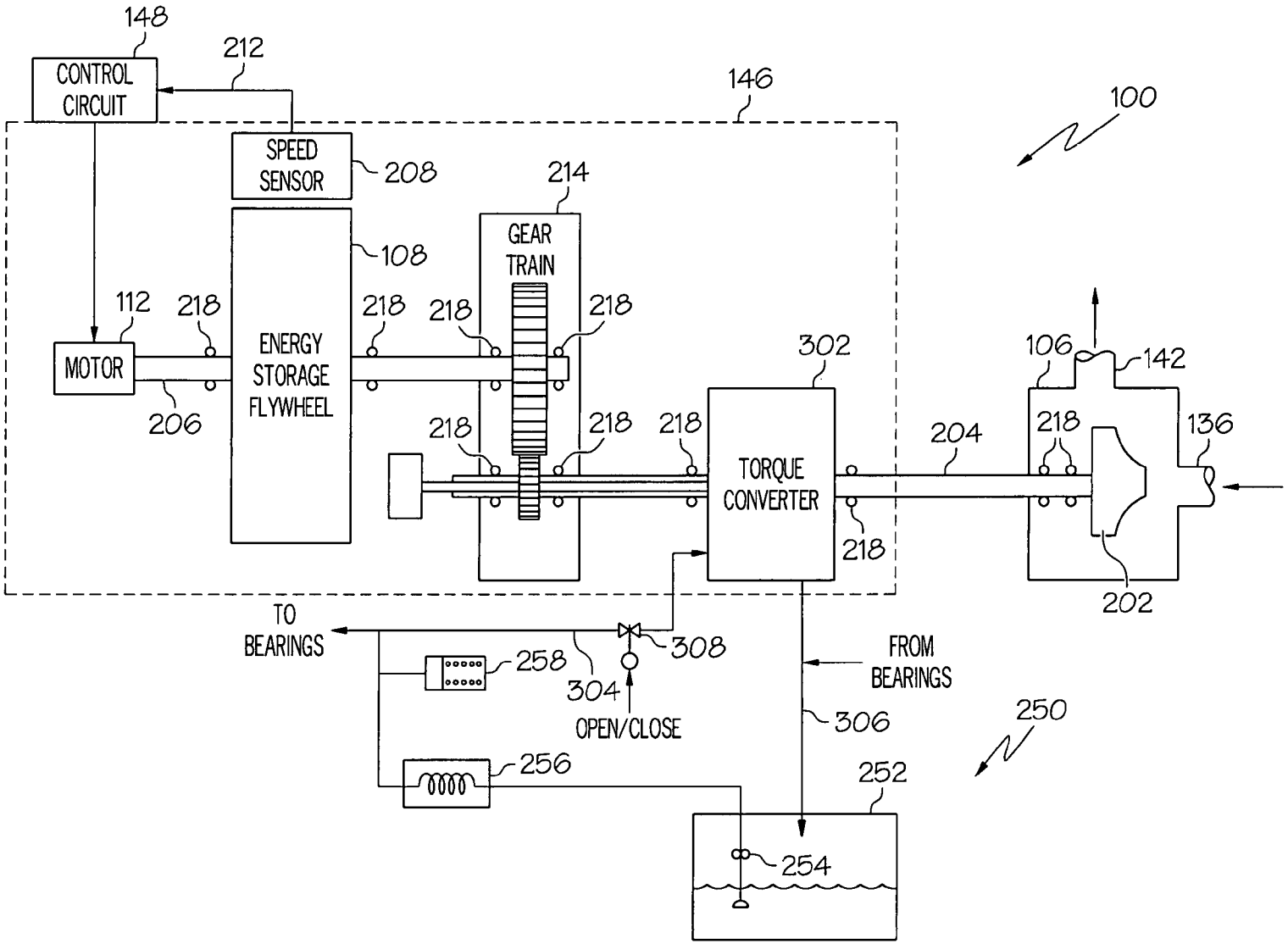
FIG. 3 is a schematic representation of a portion of the object ejection system shown in FIG. 1, according to an exemplary alternative embodiment of the present invention.

In addition to lubricating various bearing assemblies 218 and other equipment, in an alternative embodiment the lubricant system 250 is also used to control the operation of a torque converter. More specifically, and with reference now to FIG. 3, various components of such an alternative embodiment of the object ejection system 100, and the physical interconnections thereof, are illustrated. In the depicted system 100 like reference numerals refer to like components and systems depicted in FIGS. 1 and 2. Thus, identically referenced components and systems will not be further described.

The alternate system 100 includes the same components and systems as those shown in FIGS. 1 and 2, except that a torque converter 302, rather than the clutch 216, is used to selectively couple the gear train 214 and pump input shaft 204. In this regard, the lubricant supply system 250 further includes a torque converter lubricant supply conduit 304, a torque converter lubricant discharge conduit 306, and a lubricant control valve 308. The lubricant control valve 308 is coupled to receive valve open and valve close command signals from, for example, the fire control panel 150 (not shown in FIG. 3). In response to a valve open command signal, the lubricant control valve 308 opens and allows lubricant to flow into and through the torque converter 302, which causes the torque converter to couple the gear train 214 to the pump input shaft 204. Conversely, in response to an valve close command, the lubricant control valve closes and prohibits lubricant flow into the torque converter 302, which causes the torque converter 302 to decouple the gear train 214 from the pump input shaft 204.

The object ejection system 100 described herein uses an energy storage flywheel 108 to drive the fluid pump 106 that is used to supply pressurized fluid to the impulse tank 104. The system 100 includes fewer components than currently used systems that rely on pressurized air as the energy source for the fluid pump, the components that are used take up less space, and are maintained less frequently, as compared to currently used components, and are in many instances relatively quieter during operation.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A submersible vehicle object ejection system, comprising:

a fluid supply conduit having at least an inlet port coupled to a fluid source of a first pressure;

an impulse tank configured to receive fluid at a second pressure, the second pressure greater than the first pressure;

a fluid pump configured to receive a rotational drive force and operable, upon receipt thereof, to pump fluid from the fluid source to the impulse tank at the second pressure;

a rotationally mounted energy storage flywheel adapted to receive rotational energy, the energy storage flywheel configured to store the received rotational energy and to supply the stored rotational energy;

a motor coupled to the energy storage flywheel and configured, upon being electrically energized, to supply the rotational energy to the energy storage flywheel at a rotational speed;

a control circuit configured to selectively energize the motor and, upon energizing the motor, to control the rotational speed thereof;

a gear train coupled between the energy storage flywheel and the fluid pump, the gear train configured to receive the stored rotational energy supplied by the energy storage flywheel and, in response, supply the rotational drive force to the fluid pump.

2. The system of claim 1, further comprising:

a clutch disposed between the gear train and the fluid pump, the clutch coupled to receive clutch engage and clutch disengage commands and operable, upon receipt thereof, to respectively couple the gear train to, and decouple the gear train from, the fluid pump.

3. The system of claim 2, wherein the clutch comprises a magnetic clutch assembly.

4. The system of claim 2, further comprising:

a fire control circuit configured to supply the clutch engage and clutch disengage commands.

5. The system of claim 1, further comprising:

a torque converter disposed between the gear train and the fluid pump, the torque converter configured to couple the gear train to, and decouple the gear train from, the fluid pump.

6. The system of claim 5, further comprising:

a lubricant fluid circuit coupled to the torque converter, the lubricant fluid circuit adapted to supply a flow of lubricant through the torque converter; and a lubricant control valve disposed in the lubricant fluid circuit, the lubricant control valve configured to move between an open position, in which lubricant flows through the torque converter, and a closed position, in which lubricant does not flow through the torque converter.

7. The system of claim 6, wherein the lubricant supply circuit comprises:

a lubricant supply conduit coupled to the torque converter and adapted to supply the flow of lubricant to the torque converter; and a lubricant discharge conduit coupled to the torque converter and adapted to receive lubricant discharged from the torque converter, wherein the lubricant control valve is mounted on the lubricant supply conduit.

8. The system of claim 7, further comprising:

a fire control circuit configured to supply valve position command signals; and a valve actuator coupled to the lubricant control valve, the valve actuator further coupled to receive the valve position command signals and operable, in response thereto, to move the lubricant control valve between the open and closed positions.

9. The system of claim 1, further comprising:

an object ejection tube having an inlet port and an outlet port; and an object ejection control valve disposed between the object ejection tube inlet port and the impulse tank, the valve movable between an open position, in which the impulse tank is in fluid communication with the object tube inlet port, and a closed position, in which the impulse tank is fluidly isolated from the object tube inlet port.

10. The system of claim 9, further comprising:

a fire control circuit configured to supply valve position command signals; and a valve actuator coupled to the object ejection control valve, the valve actuator further coupled to receive the valve position command signals and operable, in response thereto, to move the object ejection control valve between the open and closed positions.

11. A submersible vehicle object ejection system, comprising:

a fluid supply conduit having at least an inlet port coupled to a fluid source of a first pressure;

an impulse tank configured to receive fluid at a second pressure, the second pressure greater than the first pressure;

a fluid pump configured to receive a rotational drive force and operable, upon receipt thereof, to pump fluid from the fluid source to the impulse tank;

a rotationally mounted energy storage flywheel adapted to receive rotational energy, the energy storage flywheel configured to store the received rotational energy and to supply the stored rotational energy;

a motor coupled to the energy storage flywheel and configured, upon being electrically energized, to supply the rotational energy to the energy storage flywheel at a rotational speed;

a control circuit configured to electrically energize the motor and, upon energization thereof, to control the rotational speed thereof;

a gear train coupled between the energy storage flywheel and the fluid pump, the gear train configured to receive the stored rotational energy supplied by the energy storage flywheel and, in response, supply the rotational drive force to the fluid pump; and a clutch disposed between the gear train and the fluid pump, the clutch coupled to receive clutch engage and clutch disengage commands and operable, upon receipt thereof, to respectively couple the gear train to, and decouple the gear train from, the fluid pump.

12. The system of claim 11, wherein the clutch comprises a magnetic clutch assembly.

13. The system of claim 11, further comprising:

a fire control circuit configured to supply the clutch engage and clutch disengage commands.

14. The system of claim 11, further comprising:

a object ejection tube having an inlet port and an outlet port; and a valve disposed between the object ejection tube inlet port and the impulse tank, the valve movable between an open position, in which the impulse tank is in fluid communication with the object tube inlet port, and a closed position, in which the impulse tank is fluidly isolated from the object tube inlet port;

a valve actuator coupled to the object ejection control valve, the valve actuator further coupled to receive valve position command signals and operable, in response thereto, to move the object ejection control valve between the open and closed positions; and a fire control circuit configured to supply the valve position command signals.

15. A submersible vehicle object ejection system, comprising:

a fluid supply conduit having at least an inlet port coupled to a fluid source of a first pressure;

an impulse tank configured to receive fluid at a second pressure, the second pressure greater than the first pressure;

a fluid pump configured to receive a rotational drive force and operable, upon receipt thereof, to pump fluid from the fluid source to the impulse tank;

a rotationally mounted energy storage flywheel adapted to receive rotational energy, the energy storage flywheel configured to store the received rotational energy and to supply the stored rotational energy;

a motor coupled to the energy storage flywheel and configured, upon being electrically energized, to supply the rotational energy to the energy storage flywheel at a rotational speed;

a control circuit configured to electrically energize the motor and, upon energization thereof, to control the rotational speed thereof;

a gear train coupled between the energy storage flywheel and the fluid pump, the gear train configured to receive the stored rotational energy supplied by the energy storage flywheel and, in response, supply the rotational drive force to the fluid pump; and a torque converter disposed between the gear train and the fluid pump, the torque converter configured to couple the gear train to, and decouple the gear train from, the fluid pump.

16. The system of claim 15, further comprising:

a lubricant fluid circuit coupled to the torque converter, the lubricant fluid circuit adapted to supply a flow of lubricant through the torque converter; and a lubricant control valve disposed in the lubricant fluid circuit, the lubricant control valve configured to move between an open position, in which lubricant flows through the torque converter, and a closed position, in which lubricant does not flow through the torque converter.

17. The system of claim 16, wherein the lubricant supply circuit comprises:

a lubricant supply conduit coupled to the torque converter and adapted to supply the flow of lubricant to the torque converter; and a lubricant discharge conduit coupled to the torque converter and adapted to receive lubricant discharged from the torque converter, wherein the lubricant control valve is mounted on the lubricant supply conduit.

18. The system of claim 16, further comprising:

a fire control circuit configured to supply valve position command signals; and a valve actuator coupled to the lubricant control valve, the valve actuator further coupled to receive the valve position command signals and operable, in response thereto, to move the lubricant control valve between the open and closed positions.

19. The system of claim 15, further comprising:

a object ejection tube having an inlet port and an outlet port; and a valve disposed between the object ejection tube inlet port and the impulse tank, the valve movable between an open position, in which the impulse tank is in fluid communication with the object tube inlet port, and a closed position, in which the impulse tank is fluidly isolated from the object tube inlet port;

a valve actuator coupled to the object ejection control valve, the valve actuator further coupled to receive valve position command signals and operable, in response thereto, to move the object ejection control valve between the open and closed positions; and a fire control circuit configured to supply the valve position command signals.

* * * * *